US008945055B2

(12) United States Patent
Basso et al.

(10) Patent No.: US 8,945,055 B2
(45) Date of Patent: Feb. 3, 2015

(54) INJECTION ARRANGEMENT

(75) Inventors: Nils Basso, Frankfurt am Main (DE); Thomas Nagel, Tharandt (DE); Rene Richter, Tharandt (DE); Robert Witt, Dresden (DE)

(73) Assignee: Sanofi-Aventis Deutschland GmbH, Frankurt am Main ( * ) Notice: Subject to any disclaimer, the term of this patent is extended or adjusted under 35 U.S.C. 154(b) by 557 days.

(21) Appl. No.: 13/383,999

(22) PCT Filed: Jul. 14, 2010

(86) PCT No.: PCT/EP2010/060120
§ 371 (c)(1),
(2), (4) Date: Apr. 17, 2012

(87) PCT Pub. No.: WO2011/006919
PCT Pub. Date: Jan. 20, 2011

(65) Prior Publication Data

US 2012/0197233 A1 Aug. 2, 2012

(30) Foreign Application Priority Data

Jul. 14, 2009 (EP) ..... 09009189

(51) Int. Cl.
*A61M 1/00* (2006.01)
*F04B 43/12* (2006.01)
*F04B 23/02* (2006.01)

(52) U.S. Cl.
CPC ..... *F04B 43/1253* (2013.01); *F04B 23/028* (2013.01)
USPC ..... 604/151

(58) Field of Classification Search
CPC ..... F04B 43/1253; F04B 23/028
USPC ..... 604/151, 891.1, 519, 520, 31, 65–67, 604/71, 72, 122, 131; 417/313, 474, 14, 53, 417/477.1, 477.2; 128/DIG. 1, DIG. 12, 128/DIG. 13
See application file for complete search history.

(56) References Cited

U.S. PATENT DOCUMENTS 6,109,895 A 8/2000 Ray et al.

FOREIGN PATENT DOCUMENTS

| | | | |
|---|---|---|---|
| DE | 19745999 | A1 | 4/1999 |
| WO | 2004009159 | A2 | 1/2004 |
| WO | 2008040477 | A1 | 4/2008 |

OTHER PUBLICATIONS

Form PCT/IB/326, Notification Concerning Transmittal of International Preliminary Report on Patentability.

*Primary Examiner* — Manuel Mendez
(74) *Attorney, Agent, or Firm* — McDonnell Boehnen Hulbert & Berghoff LLP

(57) ABSTRACT

The invention relates to a pump unit (2), replaceably attachable to a reusable backend (3) of an injection arrangement (1) for delivering a liquid medicament, the pump unit (2) comprising a medicament inlet (2.1), a medicament outlet (2.2) and a peristaltic pump for delivering the liquid medicament from the inlet (2.1) to the outlet (2.2), the peristaltic pump comprising a pump rotor (2.3) and a pump hose (2.4), the pump hose (2.4) partially arranged around the pump rotor (2.3), the pump rotor (2.3) having protrusions (2.5) for engaging the pump hose (2.4), wherein a fixing side (2.6) of the pump unit (2) facing a reusable backend (3) when attached has a recess (2.7) in the shape of a circular arc for allowing a correspondingly shaped stop (3.1) protruding from the reusable backend (3) to enter into the pump unit (2) so as to support the pump hose (2.4) from an outer side opposite the pump rotor (2.3) thus allowing the protrusions (2.5) to locally squeeze the pump hose (2.4) against the stop (3.1) when attached to the reusable backend (3).

13 Claims, 4 Drawing Sheets

INJECTION ARRANGEMENT

CROSS REFERENCE TO RELATED APPLICATIONS

The present application is a 35 U.S.C. 371 National Application of PCT/EP2010/060120 filed Jul. 14, 2010, which claims priority to European Patent Application No. 09009189.3 filed Jul. 14, 2009, the entire contents of which are incorporated entirely herein by reference.

The invention relates to a pump unit, replaceably attachable to a reusable backend of an injection arrangement for delivering a liquid medicament according to the preamble of claim 1. The invention further refers to the reusable backend according to the preamble of claim 7 and to the injection arrangement comprising the pump unit and the reusable backend.

Many medicaments have to be injected into the body. This applies in particular to medicaments, which are deactivated or have their efficiency remarkably decreased by oral administration, e.g. proteines (such as Insulin, growth hormones, interferons), carbohydrates (e.g. Heparin), antibodies and the majority of vaccines. Such medicaments are predominantly injected by means of syringes, medicament pens or medicament pumps.

A compact small scale peristaltic medicament pump is disclosed in DE 19 745 999. The pump comprises a delivery head, a drive unit for the delivery head, and speed control. The pump with the drive unit may be replaceably attached to a reusable backend in order to maintain a clean and sterile treatment by disposing the pump off and replacing it with a clean one after drug delivery.

WO 2008/040477 A1 discloses an injection arrangement with a peristaltic medicament pump, wherein the drive unit is integrated in the reusable backend rather than in the pump unit so the relatively expensive drive unit does not have to be disposed off every time the pump unit is replaced.

It is an object of the present invention to provide an improved pump unit and an improved reusable backend for an injection arrangement.

The object is achieved by a pump unit according to claim 1 and by a reusable backend according to claim 7.

Preferred embodiments of the invention are given in the dependent claims.

According to the invention, a pump unit is replaceably attachable to a reusable backend of an injection arrangement for delivering a liquid medicament. The pump unit comprises a medicament inlet, a medicament outlet and a peristaltic pump for delivering the liquid medicament from the inlet to the outlet. The peristaltic pump comprises a pump rotor and a pump hose, e.g. a silicone hose. The pump hose is partially arranged around a perimeter of the pump rotor. The pump rotor exhibits protrusions for engaging the pump hose. The pump unit has a fixing side facing a reusable backend when attached to it. The fixing side has a recess in the shape of a circular arc for allowing a correspondingly shaped stop protruding from the reusable backend to enter into the pump unit so as to support the pump hose from an outer side opposite the pump rotor. Thus the protrusions are allowed to locally squeeze the pump hose against the stop when the pump unit is attached to the reusable backend. When the rotor is rotated the protrusions are advanced along the pump hose thus advancing the squeezed portions of the hose and the fluid (air or the liquid medicament) in the hose ahead of the respective squeezed portion in rotational direction. Consequently, the fluid is forced out of the medicament outlet. At the same time a vacuum is created behind the advancing squeezed portion thus intaking fluid from the medicament inlet.

When the pump unit is not attached to the reusable backend, the pump hose is free to relax because of the clearance in place of the stop so the protrusions have nothing to squeeze the pump hose against. Unlike with conventional peristaltic pumps, where the pump hose is permanently squeezed after assembly of the pump unit, pumping performance of the pump unit according to the invention is not affected by visco-elastic deformation of the pump hose. Thus, the shelf-life of the pump unit is considerably increased.

The outlet may have a hollow needle attached for piercing a patient's skin.

The pump rotor and/or the pump hose may have an anti-stick coating, such as Teflon®. Thus dynamic friction between the pump hose and the pump rotor is reduced and consequently efficiency of the pump unit increased.

In a preferred embodiment the pump rotor has an adapter for engaging a drive shaft of a reusable backend. By integrating the drive unit in the reusable backend rather than in the disposable pump unit the relatively expensive drive unit does not have to be disposed off every time the pump unit is replaced.

The pump rotor may be designed as a one-part component with the protrusions being part of the rotor.

Preferably a flow sensor for determining a volume flow of the medicament is arranged in the pump unit and connectable to a control unit of a reusable backend thus allowing to control the volume of medicament to be delivered.

The pump unit has easily disconnectable interfaces to the medicament container (ampoule), drive unit and control unit on the one hand and to the injection needle on the other hand.

A reusable backend according to the invention comprises a replaceable medicament container, a control unit, a drive unit and an energy source. The reusable backend is attachable to a replaceable pump unit. The reusable backend comprises a stop with a circular arc profile protruding from a front side facing the replaceable pump unit when attached to it. The stop is arranged for entering a correspondingly shaped recess in the replaceable pump unit so as to support a pump hose of the pump unit from an outer side opposite a pump rotor of the pump unit. Thus protrusions of the rotor are allowed to locally squeeze the pump hose against the stop when the two parts are attached to each other. The reusable backend may be used over the service-life of the entire injection arrangement while the pump unit may be replaced after each medicament delivery.

The control unit is connectable to a flow sensor for determining a flow of the medicament arranged in the pump unit, thus allowing to control the volume of medicament to be delivered.

The energy source for the drive unit may be a galvanic cell or battery of galvanic cells in case the drive unit comprises an electrical motor. Preferably the energy source is a rechargeable accumulator. The rechargeable accumulator may be replaceable or chargeable in place by an external charging device arranged for holding the reusable backend.

The reusable backend may further have a user interface for user interaction. This may comprise a dosing and/or trigger knob or wheel and/or a display, e.g for displaying a dose volume.

According to the invention an injection arrangement for delivering a liquid medicament comprises a pump unit and a reusable backend as specified above.

The pump unit or the reusable backend or the injection arrangement may preferably be used for delivering one of an analgetic, an anticoagulant, Insulin, an Insulin derivate, Heparin, Lovenox, a vaccine, a growth hormone and a peptide hormone.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein:

Corresponding parts are marked with the same reference symbols in all figures.

FIG. 1 shows a perspective partial view of an injection arrangement 1 for delivering a liquid medicament with a replaceable pump unit 2 and a reusable backend 3 during assembly.

Figure 1:
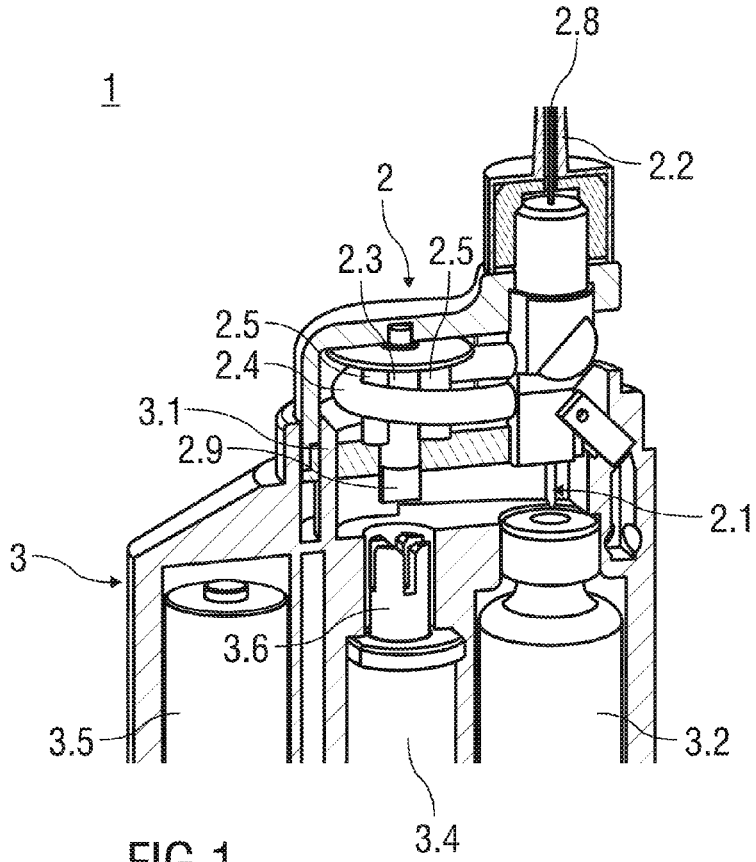
FIG. 1 is a perspective sectional view of an injection arrangement with a replaceable pump unit and a reusable backend during assembly.
Figure 2:
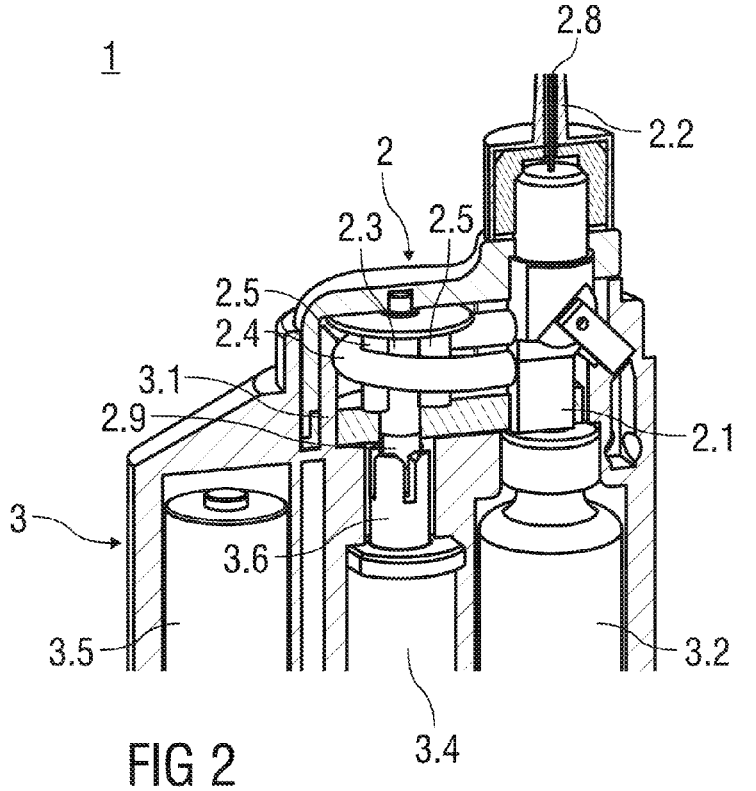
FIG. 2 is a perspective sectional view of the injection arrangement in an assembled state.
Figure 3:
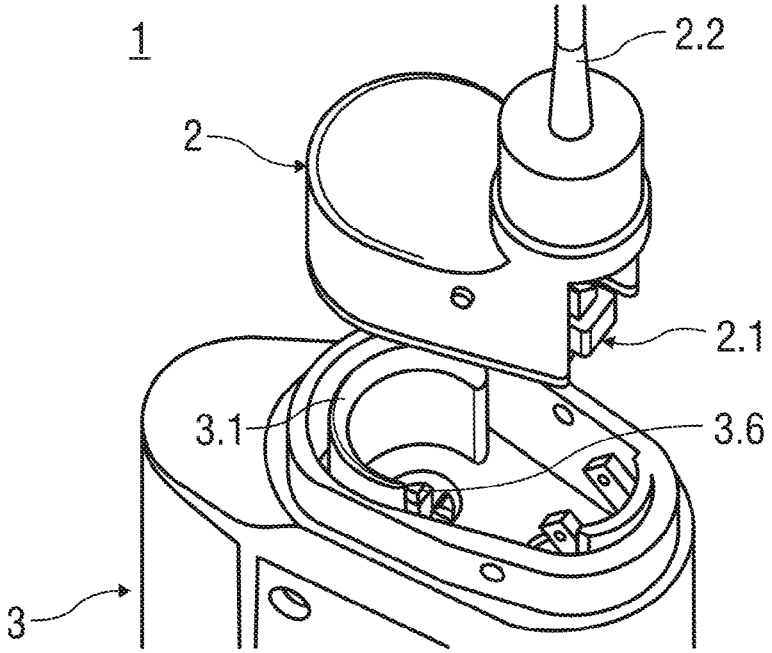
FIG. 3 is a perspective partial view of the injection arrangement prior to or after assembly.
Figure 4:
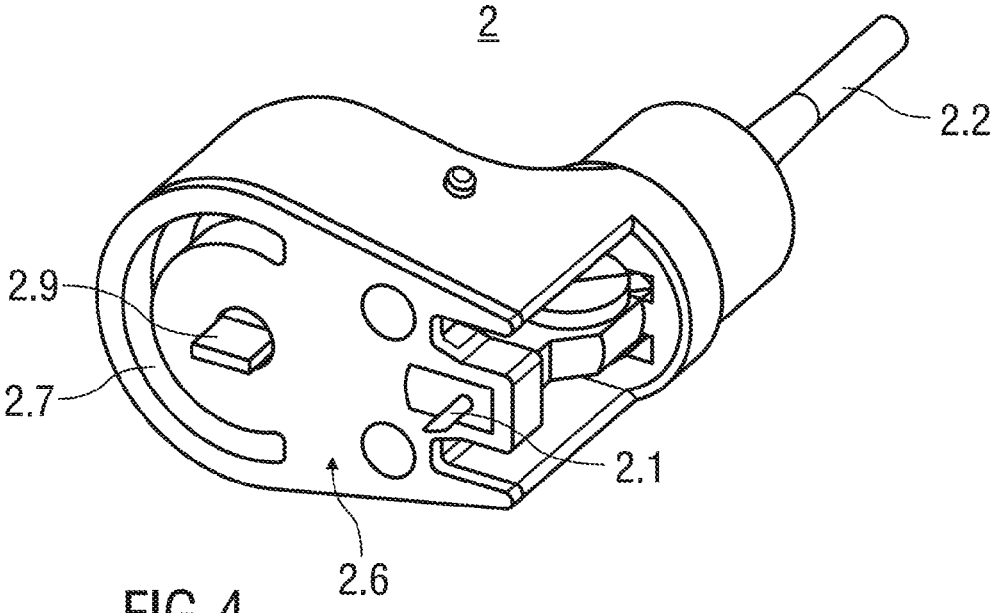
FIG. 4 is a perspective view of the pump unit.
Figure 5:
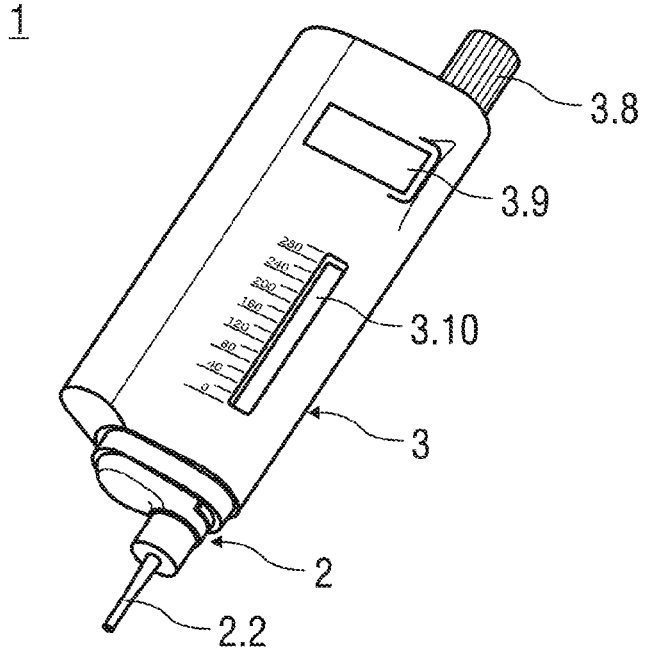
FIG. 5 is a perspective view of the assembled injection arrangement.

The pump unit 2 is replaceably attachable to the reusable backend 3. The pump 2 unit comprises a medicament inlet 2.1, a medicament outlet 2.2 and a peristaltic pump for delivering the liquid medicament from the inlet 2.1 to the outlet 2.2. The peristaltic pump comprises a pump rotor 2.3 and a pump hose 2.4, e.g. a silicone hose. The pump hose 2.4 is partially arranged around a perimeter of the pump rotor 2.3. The pump rotor 2.3 exhibits protrusions 2.5 for engaging the pump hose 2.4. The pump unit 2 has a fixing side 2.6 facing the reusable backend 3, which is best shown in FIG. 4. The fixing side 2.6 has a recess 2.7 in the shape of a circular arc for allowing a correspondingly shaped stop 3.1 protruding from the reusable backend 3 to enter into the pump unit 2. The stop 3.1 is shown in FIGS. 1, 2 and 3. When the pump unit 2 and the reusable backend 3 are assembled as shown in FIG. 2, the stop 3.1 supports the pump hose 2.4 from an outer side opposite the pump rotor 2.3. Thus the protrusions 2.5 are allowed to locally squeeze the pump hose 2.4 against the stop 3.1. When the rotor 2.3 is rotated the protrusions 2.5 are advanced along the pump hose 2.4 thus advancing the squeezed portions of the hose 2.4 and the fluid (air or the liquid medicament) in the hose 2.4 ahead of the respective squeezed portion in rotational direction. Consequently, the fluid is forced out of the medicament outlet 2.2. At the same time a vacuum is created behind the advancing squeezed portion thus intaking fluid from the medicament inlet 2.1.

When the pump unit 2 is not attached to the reusable backend 3, the pump hose 2.4 is free to relax because of the clearance in place of the stop 3.1 so the protrusions 2.5 have nothing to squeeze the pump hose 2.4 against.

Figure 7:
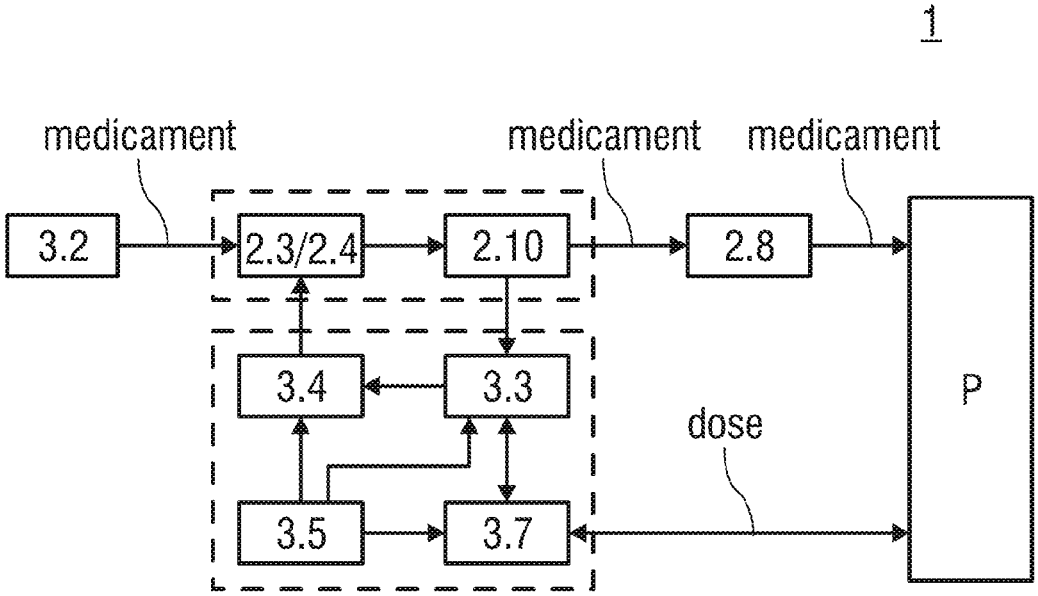
FIG. 7 is a schematic view of the injection arrangement.

The reusable backend 3 comprises a replaceable medicament container 3.2, a control unit 3.3 shown in the schematic view in FIG. 7, a drive unit 3.4 and an energy source 3.5 for powering the drive unit 3.4.

The medicament container 3.2 may have a septum which is pierced by a backwardly pointing needle of the medicament inlet 2.1.

The medicament outlet 2.2 may have a hollow needle 2.8 attached for piercing a patients P skin. Alternatively, a jet nozzle may be provided.

The pump rotor 2.3 and/or the pump hose 2.4 may have an anti-stick coating, such as Teflon®.

The pump rotor 2.3 has an adapter 2.9 for engaging a drive shaft 3.6 connected to the drive unit 3.4 of the reusable backend 3. The drive shaft 3.6 is preferably designed in a manner to ease this engagement (cf. FIGS. 1 and 2).

The pump rotor 2.3 is preferably designed as a one-part component with the protrusions 2.5 and the adapter 2.9 being part of the rotor 2.3.

The pump unit 2 further comprises a flow sensor 2.10 (shown in FIG. 7) for determining a flow or volume flow of the medicament. The flow sensor 2.10 is connectable to the control unit 3.3 thus allowing to control the volume of medicament to be delivered.

The pump unit 2 has easily disconnectable interfaces to the medicament container 3.2 (ampoule), the drive unit 3.4 and the control unit 3.3 on the one hand and to the hollow injection needle 2.8 on the other hand, e.g. by Luer-Lok® or Luer-Slip®.

Figure 6:
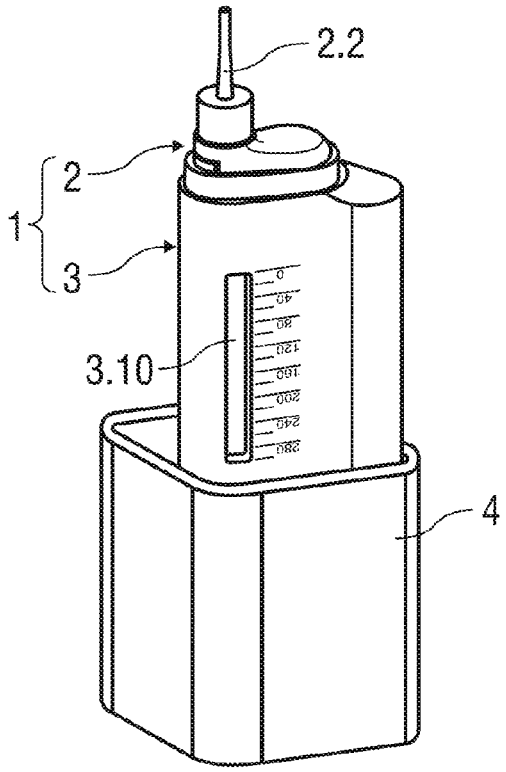
FIG. 6 is a perspective view of the injection arrangement held in a charger.

The energy source 3.5 may be a galvanic cell or battery of galvanic cells in case the drive unit 3.4 comprises an electrical motor. Preferably, the energy source 3.5 is a rechargeable accumulator. The rechargeable accumulator may be replaceable or chargeable in place by an external charging device 4 arranged for holding the reusable backend 3 (see FIG. 6).

The reusable backend 3 may further have a user interface 3.7 for user interaction. This may comprise a dosing and/or trigger knob 3.8 or wheel and/or a display 3.9, e.g for displaying a dose volume.

The reusable backend 3 may further comprise a viewing window 3.10 for inspecting the contents of the medicament container 3.2.

The pump unit 2 or the reusable backend 3 or the injection arrangement 1 may preferably be used for delivering one of an analgetic, an anticoagulant, Insulin, Insulin derivate, Heparin, Lovenox, a vaccine, a growth hormone and a peptide hormone.

For performing an injection a user sets a required target dose at the user interface 3.7. The required target dose is forwarded to the control unit 3.3 and stored there. As soon as the user triggers the injection arrangement, e.g by pressing the knob 3.8, the target dose is converted into a flow sensor setpoint and the drive unit 3.4 is started. The drive unit 3.4 converts the electrical energy provided by the energy source 3.5 into mechanical energy and forwards it to the peristaltic pump. There the energy is again converted into fluidic energy causing a volume flow of the medicament. The integrated flow sensor 2.10 acquires the volume flow and forwards measurement values to the control unit. The measurement values, particularly when in the shape of increments corresponding to volume increments may be integrated by the control unit 3.3 and the drive unit 3.4 switched off upon delivery of the setpoint volume. After delivery the control unit 3.3 may generate a message for the user to be displayed by the display unit 3.9.

The term "medicament", as used herein, means a pharmaceutical formulation containing at least one pharmaceutically active compound, wherein in one embodiment the pharmaceutically active compound has a molecular weight up to 1500 Da and/or is a peptide, a proteine, a polysaccharide, a vaccine, a DNA, a RNA, a antibody, an enzyme, an antibody, a hormone or an oligonucleotide, or a mixture of the above-mentioned pharmaceutically active compound, wherein in a further embodiment the pharmaceutically active compound is useful for the treatment and/or prophylaxis of diabetes mellitus or complications associated with diabetes mellitus such as diabetic retinopathy, thromboembolism disorders such as deep vein or pulmonary thromboembolism, acute coronary syndrome (ACS), angina, myocardial infarction, cancer, macular degeneration, inflammation, hay fever, atherosclerosis and/or rheumatoid arthritis, wherein in a further embodiment the pharmaceutically active compound comprises at least one peptide for the treatment and/or prophylaxis of diabetes mellitus or complications associated with diabetes mellitus such as diabetic retinopathy, wherein in a further embodiment the pharmaceutically active compound comprises at least one human insulin or a human insulin analogue or derivative, glucagon-like peptide (GLP-1) or an analogue or derivative thereof, or exedin-3 or exedin-4 or an analogue or derivative of exedin-3 or exedin-4.

Insulin analogues are for example Gly(A21), Arg(B31), Arg(B32) human insulin; Lys(B3), Glu(B29) human insulin; Lys(B28), Pro(B29) human insulin; Asp(B28) human insulin; human insulin, wherein proline in position B28 is replaced by Asp, Lys, Leu, Val or Ala and wherein in position B29 Lys may be replaced by Pro; Ala(B26) human insulin; Des(B28-B30) human insulin; Des(B27) human insulin and Des(B30) human insulin.

Insulin derivates are for example B29-N-myristoyl-des(B30) human insulin; B29-N-palmitoyl-des(B30) human insulin; B29-N-myristoyl human insulin; B29-N-palmitoyl human insulin; B28-N-myristoyl LysB28ProB29 human insulin; B28-N-palmitoyl-LysB28ProB29 human insulin; B30-N-myristoyl-ThrB29LysB30 human insulin; B30-N-palmitoyl-ThrB29LysB30 human insulin; B29-N-(N-palmitoyl-Y-glutamyl)-des(B30) human insulin; B29-N-(N-lithocholyl-Y-glutamyl)-des(B30) human insulin; B29-N-(ω-carboxyheptadecanoyl)-des(B30) human insulin and B29-N-(ω-carboxyheptadecanoyl) human insulin.

Exendin-4 for example means Exendin-4(1-39), a peptide of the sequence H His-Gly-Glu-Gly-Thr-Phe-Thr-Ser-Asp-Leu-Ser-Lys-Gln-Met-Glu-Glu-Glu-Ala-Val-Arg-Leu-Phe-Ile-Glu-Trp-Leu-Lys-Asn-Gly-Gly-Pro-Ser-Ser-Gly-Ala-Pro-Pro-Pro-Ser-NH2.

Exendin-4 derivatives are for example selected from the following list of compounds:

H-(Lys)4-des Pro36, des Pro37 Exendin-4(1-39)-NH2,
H-(Lys)5-des Pro36, des Pro37 Exendin-4(1-39)-NH2,
des Pro36 [Asp28] Exendin-4(1-39),
des Pro36 [IsoAsp28] Exendin-4(1-39),
des Pro36 [Met(O)14, Asp28] Exendin-4(1-39),
des Pro36 [Met(O)14, IsoAsp28] Exendin-4(1-39),
des Pro36 [Trp(O2)25, Asp28] Exendin-4(1-39),
des Pro36 [Trp(O2)25, IsoAsp28] Exendin-4(1-39),
des Pro36 [Met(O)14 Trp(O2)25, Asp28] Exendin-4(1-39),
des Pro36 [Met(O)14 Trp(O2)25, IsoAsp28] Exendin-4(1-39); or
des Pro36 [Asp28] Exendin-4(1-39),
des Pro36 [IsoAsp28] Exendin-4(1-39),
des Pro36 [Met(O)14, Asp28] Exendin-4(1-39),
des Pro36 [Met(O)14, IsoAsp28] Exendin-4(1-39),
des Pro36 [Trp(O2)25, Asp28] Exendin-4(1-39),
des Pro36 [Trp(O2)25, IsoAsp28] Exendin-4(1-39),
des Pro36 [Met(O)14 Trp(O2)25, Asp28] Exendin-4(1-39),
des Pro36 [Met(O)14 Trp(O2)25, IsoAsp28] Exendin-4(1-39),
wherein the group -Lys6-NH2 may be bound to the C-terminus of the Exendin-4 derivative;
or an Exendin-4 derivative of the sequence
H-(Lys)6-des Pro36 [Asp28] Exendin-4(1-39)-Lys6-NH2,
des Asp28 Pro36, Pro37, Pro38Exendin-4(1-39)-NH2,
H-(Lys)6-des Pro36, Pro38 [Asp28] Exendin-4(1-39)-NH2,
H-Asn-(Glu)5des Pro36, Pro37, Pro38 [Asp28] Exendin-4 (1-39)-NH2,
des Pro36, Pro37, Pro38 [Asp28] Exendin-4(1-39)-(Lys)6-NH2,
H-(Lys)6-des Pro36, Pro37, Pro38 [Asp28] Exendin-4(1-39)-(Lys)6-NH2,
H-Asn-(Glu)5-des Pro36, Pro37, Pro38 [Asp28] Exendin-4 (1-39)-(Lys)6-NH2,
H-(Lys)6-des Pro36 [Trp(O2)25, Asp28] Exendin-4(1-39)-Lys6-NH2,
H-des Asp28 Pro36, Pro37, Pro38 [Trp(O2)25] Exendin-4(1-39)-NH2,
H-(Lys)6-des Pro36, Pro37, Pro38 [Trp(O2)25, Asp28] Exendin-4(1-39)-NH2,
H-Asn-(Glu)5-des Pro36, Pro37, Pro38 [Trp(O2)25, Asp28] Exendin-4(1-39)-NH2,
des Pro36, Pro37, Pro38 [Trp(O2)25, Asp28] Exendin-4(1-39)-(Lys)6-NH2,
H-(Lys)6-des Pro36, Pro37, Pro38 [Trp(O2)25, Asp28] Exendin-4(1-39)-(Lys)6-NH2,
H-Asn-(Glu)5-des Pro36, Pro37, Pro38 [Trp(O2)25, Asp28] Exendin-4(1-39)-(Lys)6-NH2,
H-(Lys)6-des Pro36 [Met(O)14, Asp28] Exendin-4(1-39)-Lys6-NH2,
des Met(O)14 Asp28 Pro36, Pro37, Pro38 Exendin-4(1-39)-NH2,
H-(Lys)6-desPro36, Pro37, Pro38 [Met(O)14, Asp28] Exendin-4(1-39)-NH2,
H-Asn-(Glu)5-des Pro36, Pro37, Pro38 [Met(O)14, Asp28] Exendin-4(1-39)-NH2,
des Pro36, Pro37, Pro38 [Met(O)14, Asp28] Exendin-4(1-39)-(Lys)6-NH2,
H-(Lys)6-des Pro36, Pro37, Pro38 [Met(O)14, Asp28] Exendin-4(1-39)-(Lys)6-NH2,
H-Asn-(Glu)5 des Pro36, Pro37, Pro38 [Met(O)14, Asp28] Exendin-4(1-39)-(Lys)6-NH2,
H-Lys6-des Pro36 [Met(O)14, Trp(O2)25, Asp28] Exendin-4(1-39)-Lys6-NH2,
H-des Asp28 Pro36, Pro37, Pro38 [Met(O)14, Trp(O2)25] Exendin-4(1-39)-NH2,
H-(Lys)6-des Pro36, Pro37, Pro38 [Met(O)14, Asp28] Exendin-4(1-39)-NH2,
H-Asn-(Glu)5-des Pro36, Pro37, Pro38 [Met(O)14, Trp(O2) 25, Asp28] Exendin-4(1-39)-NH2,
des Pro36, Pro37, Pro38 [Met(O)14, Trp(O2)25, Asp28] Exendin-4(1-39)-(Lys)6-NH2,
H-(Lys)6-des Pro36, Pro37, Pro38 [Met(O)14, Trp(O2)25, Asp28] Exendin-4(S1-39)-(Lys)6-NH2,
H-Asn-(Glu)5-des Pro36, Pro37, Pro38 [Met(O)14, Trp(O2) 25, Asp28] Exendin-4(1-39)-(Lys)6-NH2;
or a pharmaceutically acceptable salt or solvate of any one of the afore-mentioned Exedin-4 derivative.

Hormones are for example hypophysis hormones or hypothalamus hormones or regulatory active peptides and their antagonists as listed in Rote Liste, ed. 2008, Chapter 50, such as Gonadotropine (Follitropin, Lutropin, Choriongonadotropin, Menotropin), Somatropine (Somatropin), Desmopressin, Terlipressin, Gonadorelin, Triptorelin, Leuprorelin, Buserelin, Nafarelin, Goserelin.

A polysaccharide is for example a glucosaminoglycane, a hyaluronic acid, a heparin, a low molecular weight heparin or an ultra low molecular weight heparin or a derivative thereof, or a sulphated, e.g. a poly-sulphated form of the above-mentioned polysaccharides, and/or a pharmaceutically acceptable salt thereof. An example of a pharmaceutically acceptable salt of a poly-sulphated low molecular weight heparin is enoxaparin sodium.

Pharmaceutically acceptable salts are for example acid addition salts and basic salts. Acid addition salts are e.g. HCl or HBr salts. Basic salts are e.g. salts having a cation selected from alkali or alkaline, e.g. Na+, or K+, or Ca2+, or an ammonium ion N+(R1)(R2)(R3)(R4), wherein R1 to R4 independently of each other mean: hydrogen, an optionally substituted C1 C6-alkyl group, an optionally substituted C2-C6-alkenyl group, an optionally substituted C6-C10-aryl group, or an optionally substituted C6-C10-heteroaryl group. Further examples of pharmaceutically acceptable salts are described in "Remington's Pharmaceutical Sciences" 17. ed. Alfonso R. Gennaro (Ed.), Mark Publishing Company, Easton, Pa., U.S.A., 1985 and in Encyclopedia of Pharmaceutical Technology.

Pharmaceutically acceptable solvates are for example hydrates.

LIST OF REFERENCES

1 injection arrangement
2 pump unit
  medicament inlet
  medicament outlet
  pump rotor
  pump hose
  protrusion
  fixing side
  recess
  hollow needle
  adapter
  flow sensor
3 reusable backend
  stop
  medicament container
  control unit
  drive unit
  energy source
  drive shaft
  user interface
  dosing/trigger knob
  display
  viewing window
4 charging device
P patient

The invention claimed is:

1. A pump unit, replaceably attachable to a reusable backend of an injection arrangement for delivering a liquid medicament, the pump unit comprising a medicament inlet, a medicament outlet and a peristaltic pump for delivering the liquid medicament from the inlet to the outlet, the peristaltic pump comprising a pump rotor and a pump hose, the pump hose partially arranged around the pump rotor, the pump rotor having protrusions for engaging the pump hose, characterized in that a fixing side of the pump unit facing a reusable backend when attached has a recess in the shape of a circular arc for allowing a correspondingly shaped stop protruding from the reusable backend to enter into the pump unit so as to support the pump hose from an outer side opposite the pump rotor thus allowing the protrusions to locally squeeze the pump hose against the stop when attached to the reusable backend.

2. Pump unit according to claim 1, characterized in that the recess is arranged for allowing the pump hose to relax before or after being attached to a reusable backend.

3. Pump unit according to claim 1, characterized in that the pump rotor and/or the pump hose have/has an anti-stick coating.

4. Pump unit according to claim 1, characterized in that the pump rotor has an adapter for engaging a drive shaft of a reusable backend.

5. Pump unit according to claim 4, characterized in that the pump rotor is a one-part component.

6. Pump unit according to claim 1, characterized in that a flow sensor for determining a volume flow of the medicament is arranged in the pump unit and connectable to a control unit of a reusable backend.

7. Reusable backend for an injection arrangement for delivering a liquid medicament, comprising a medicament container, a control unit, a drive unit and an energy source, the reusable backend attachable to a replaceable pump unit, characterized in that the reusable backend comprises a stop with a circular arc profile protruding from a front side facing the replaceable pump unit when attached for entering a correspondingly shaped recess in the replaceable pump unit so as to support a pump hose of the pump unit from an outer side opposite a pump rotor of the pump unit thus allowing protrusions of the rotor to locally squeeze the pump hose against the stop.

8. Reusable backend according to claim 7, characterized in that the control unit is connectable to a flow sensor for determining a volume flow of the medicament arranged in the pump unit.

9. Reusable backend according to claim 7, characterized in that the energy source is a rechargeable accumulator.

10. Reusable backend according to claim 9, characterized in that the rechargeable accumulator is chargeable by an external charging device arranged for holding the reusable backend.

11. Reusable backend according to claim 7, characterized in that a user interface for user interaction is arranged.

12. Injection arrangement for delivering a liquid medicament, comprising a pump unit according to claim 1 and a reusable backend according to claim 7.

13. Use of an injection arrangement according to claim 12 for delivering one of an analgetic, an anticoagulant, Insulin, an Insulin derivate, Heparin, Lovenox, a vaccine, a growth hormone and a peptide hormone.

* * * * *